United States Patent [19]

Hanson

[11] Patent Number: 5,025,771

[45] Date of Patent: Jun. 25, 1991

[54] CROSSBOW

[76] Inventor: Brooks K. Hanson, 4075 S. Mt. Olympus Way, Salt Lake City, Utah 84124

[21] Appl. No.: 408,802

[22] Filed: Sep. 19, 1989

[51] Int. Cl.[5] ..... F41B 5/12

[52] U.S. Cl. ..... 124/25; 124/35.1; 124/40

[58] Field of Search ..... 124/25, 40, 35 R, 31, 124/87, 35.1

[56] References Cited

U.S. PATENT DOCUMENTS

| | | | |
|---|---|---|---|
| 3,224,427 | 12/1965 | Ronan | 124/35 R X |
| 3,739,765 | 6/1973 | Moore | 124/25 |
| 4,173,964 | 11/1979 | Curran | 124/40 |
| 4,192,281 | 3/1980 | King | 124/25 |
| 4,649,893 | 3/1987 | Heitz | 124/40 X |
| 4,716,880 | 1/1988 | Adkins | 124/25 |
| 4,877,008 | 10/1989 | Troubridge | 124/25 |

*Primary Examiner*—Peter M. Cuomo

*Attorney, Agent, or Firm*—Mallinckrodt & Mallinckrodt

[57] ABSTRACT

A crossbow incorporates a simplified trigger and bow string release assembly which includes a single piece trigger and bow string release member pivotally mounted within the stock. A spring urges the trigger and bow string release member about its pivot axis to its bow string holding position. A safety mechanism is provided to prevent rotation of the trigger and bow string release member when the safety is "on". The crossbow stock is preferably formed of two molded stock halves which are secured together to pivotally mount the trigger and bow string release member therebetween. The crossbow also preferably includes a nose piece with an integral cocking stirrup.

24 Claims, 3 Drawing Sheets

CROSSBOW

BACKGROUND OF THE INVENTION

1. Field

The invention is in the field of crossbows

2. State of the Art

Crossbows differ from archery bows in several ways, one of the most significant being that the axis of the bow itself, called a prod in a crossbow configuration, is horizontal rather than vertical. Another difference is that the prod is attached to a stock, shaped and sized much like a rifle or shotgun. In addition, the bow string is cocked and held in place by a trigger and bow string release mechanism wherein the trigger is similar to the trigger in a rifle or shotgun.

One of the problems associated with the use of the usual crossbow is the cocking procedure. In order to cock the crossbow the user must hold the stock substantially motionless, such as by pressing the butt of the stock against his shoulder, and draw back the bowstring until it can be locked in place by the trigger and bow string release mechanism. For the average user this limits the draw weight to approximately 150 lbs. This is insufficient for some big game for which a draw weight of approximately 200 lbs. is desired.

Another problem associated with the usual crossbow is the requirement for protection against accidental triggering of the arrow. There has been established a "Crossbow Security Test Specification" with which a crossbow is supposed to comply in order to prevent accidental discharge. This test requires the crossbow to be dropped in the cocked position from a height of four feet onto a concrete surface in six different positions. It is then struck with a mallet and the trigger mechanism and safety are subjected to substantial overload. It is also exposed to extreme heat, cold, various lubricants and solvents. Throughout this test no accidental discharge should occur.

In order to pass this test, state of the art crossbows have fairly complex trigger and safety latch mechanisms, employing several parts, which serve to increase the cost significantly. Oftentimes, it may be possible for a user to modify these mechanisms in order to effect a more "hair trigger" action, which is undesirable in that it reduces the safety of the crossbow.

State of the art crossbows also usually incorporate a so-called Monte Carlo cheek piece which is a recurved surface on one side and near the rear or butt end of the stock configured to comfortably bear against the check of a user. This is usually placed on the left side so that a user may take advantage of it when sighting with his right eye. Such positioning is designed for right-handed people, but is on the wrong side of the stock for use by left-handed people.

SUMMARY OF THE INVENTION

A principal objective in the making of the invention was to provide a simplified and less expensive trigger and bow string release mechanism, and accompanying safety latch, which would pass the Crossbow Security Test Specification without accidental discharge. This is effected in the invention by the use of a novel die-cast unitary trigger and bow string release member positioned in cooperating recesses in the stock and pivoted on a pin such that as the trigger is pulled backwardly the bow string release portion rotates forwardly, thus releasing the bow string which then launched the arrow. Cooperating with this trigger and bowstring release member is a compression spring which is also enclosed in the stock, one end of which bears against the stock and the other end of which bears against the die-cast member and which is so emplaced as to urge the trigger forwardly, thus keeping it in the cocked position. The spring is so sized, and the trigger pivotal crank arm is so configured, as to require a force of approximately seven lbs. bearing against the trigger to compress it. The bow string release crank arm is so configured that a much greater force, in excess of 200 pounds, must be exerted against it by the cocked bow string before the spring can be compressed and thus the bow string released. A safety latch is also incorporated, enclosed in the stock, which can be pushed rearwardly into a safety "on" position or forwardly into a safety "off" position. When in the safety "on" position the latch engages the trigger mechanism such that the trigger can not be pulled.

The bow stock is shaped generally like a rifle stock and is fashioned from two molded matching longitudinal half-segments having apposite edges which are affixed together by cementing. This feature seals the trigger and bow string release member, and also the safety latch, inside the stock of the crossbow thus preventing the user from altering the mechanism, such as by substituting a lighter spring, to achieve a more "hair trigger" response, which action would decrease the safety aspect of the crossbow.

The butt end of the stock is fashioned with a Monte Carlo cheek piece on each side so that a user may enjoy this feature when using either his right eye or his left eye for aiming. Thus, the same crossbow may be used by either right-handed or left-handed people.

A two-footed cocking stirrup located near the nose of the bow stock has two transverse projections protruding therefrom on which the user may place one or both of his feet, thus holding the nose of the bow substantially stationary and leaving one or both of his hands free for drawing back the bow string in order to cock the crossbow. The cocking stirrup is preferably an integral part of a nose piece secured to the nose of the stock.

THE DRAWINGS

The best mode presently contemplated for carrying out the invention in actual practice is illustrated in the accompanying drawings, in which:

FIG. 1 is a perspective view of the crossbow assembly shown in cocked position with an arrow emplaced theron and incorporating a prod, a bow string, a front sight and a rear sight;

FIG. 2, a partial perspective view of the cross bow assembly with an alternative rear scope sight mounted theron and the nose piece, prod, and bow string removed;

FIG. 3, a vertical section taken along the line 3—3 of FIG. 2;

FIG. 4, a fragmentary vertical section taken along the line 4—4 of FIG. 3 showing the trigger and bow string release member and the trigger safety latch assembled to the stock and showing the trigger and bow string release member in elevation;

FIG. 5, a vertical section taken along the irregular line 5—5 of FIG. 4;

FIG. 6, a fragmentary vertical section taken on the line 6—6 of FIG. 4 to show the pivotal mounting of the trigger and bowstring release member in the stock; and FIG. 7, a schematic representation showing the trigger and bow string release member, the safety latch in the safety "on" position, and the relationship between the direction of force of the cocked bowstring and the bow string release pivotal crank arm.

DETAILED DESCRIPTION OF THE ILLUSTRATED EMBODIMENT

Figure 1:
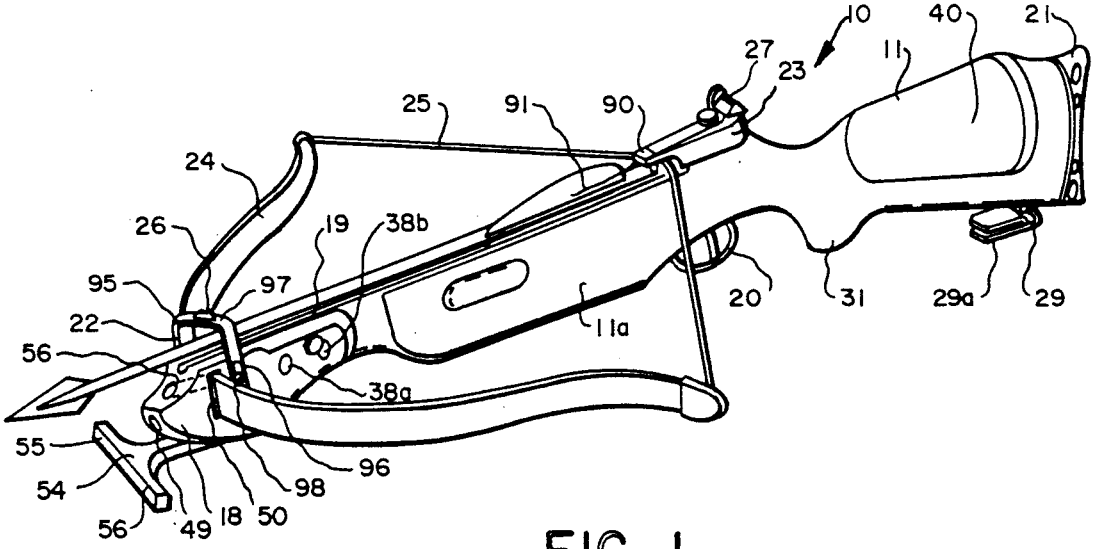

As shown in FIG. 1, a typical crossbow of the invention includes a stock 11, a trigger and bow string release member 12, a nose piece 18 secured to the forward or nose portion of stock 11, a prod 24 secured to the nose piece 18, and a bow string 25 connected between respective tip ends of the prod 24. The crossbow also includes a usual trigger guard 20, a recoil pad 21, a front sight mounting member 22 with a front sight 26 mounted thereon, and a rear sight mounting member 23 with rear sight 27, FIG. 1, or scope sight 28, FIG. 2, mounted thereon. Sling mounting brackets 29 may be provided for mounting a sling 29*a* in normal manner. FIG. 1 shows the crossbow in cocked position wherein bow string 25 has been drawn to bend, and thereby stress, prod 24 and bow string 25 is held in drawn position by the bow string release portion of the trigger and bow string release mechanism 12. An arrow 45 is shown resting in arrow track 19.

Figure 2:
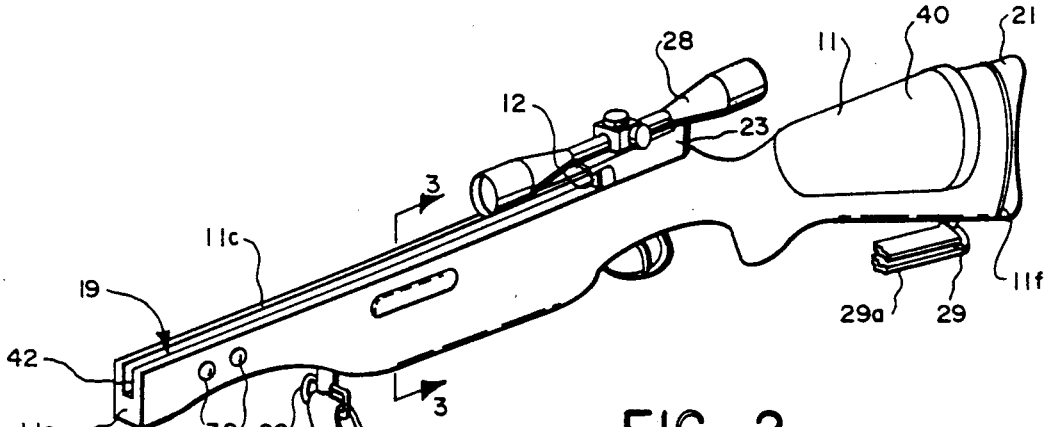
Figure 3:
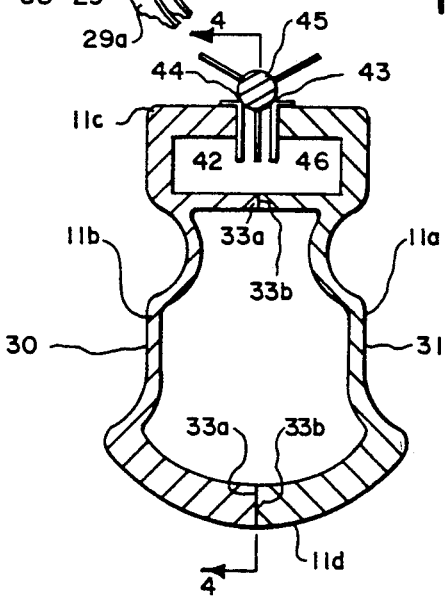
Figure 4:
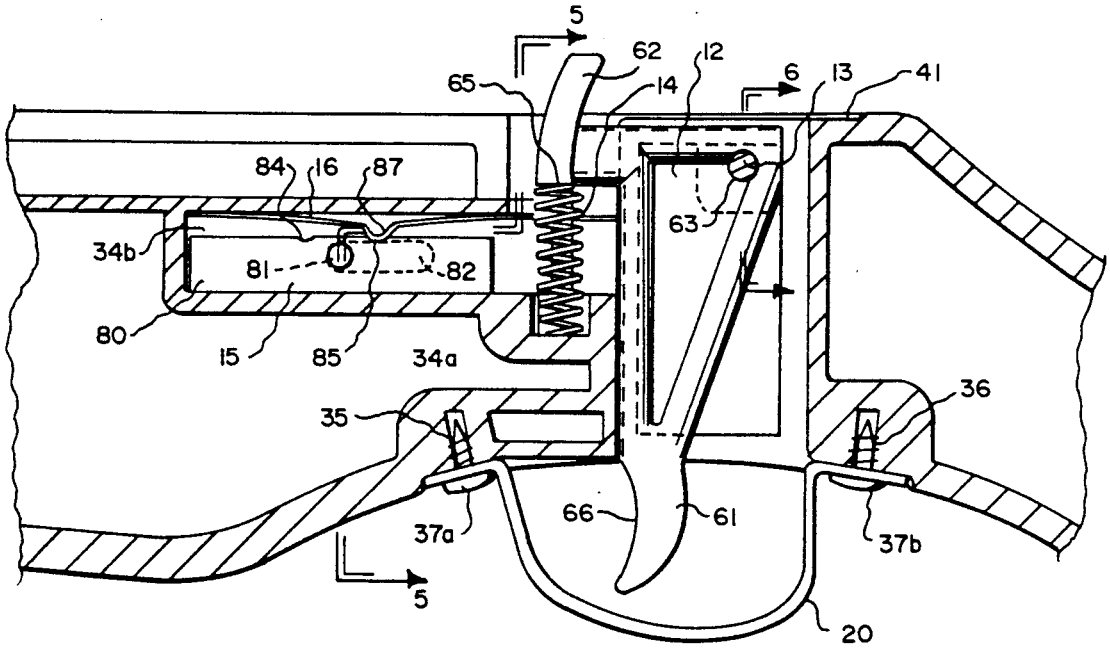

The basic crossbow assembly 10 of the invention includes the stock 11 which has two opposing, relatively flat side surfaces 11*a* and 11*b*, FIG. 3, a relatively narrow upper surface 11*a*, a relatively narrow lower surface 11*d*, a front nose surface 11*e*, FIG. 2, and a rear butt surface 11*f*; the trigger and bow string release member 12; pivot means in the form of a pivot pin 13, FIG. 4, which is pivotally received and held in the stock; and a retraction spring 14.

Figure 5:
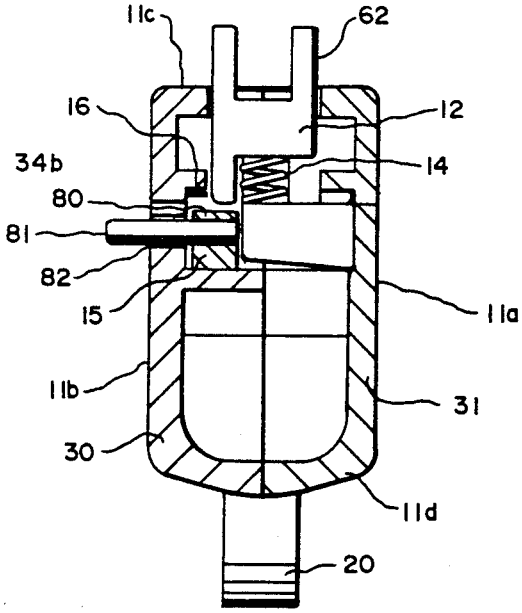
Figure 7:
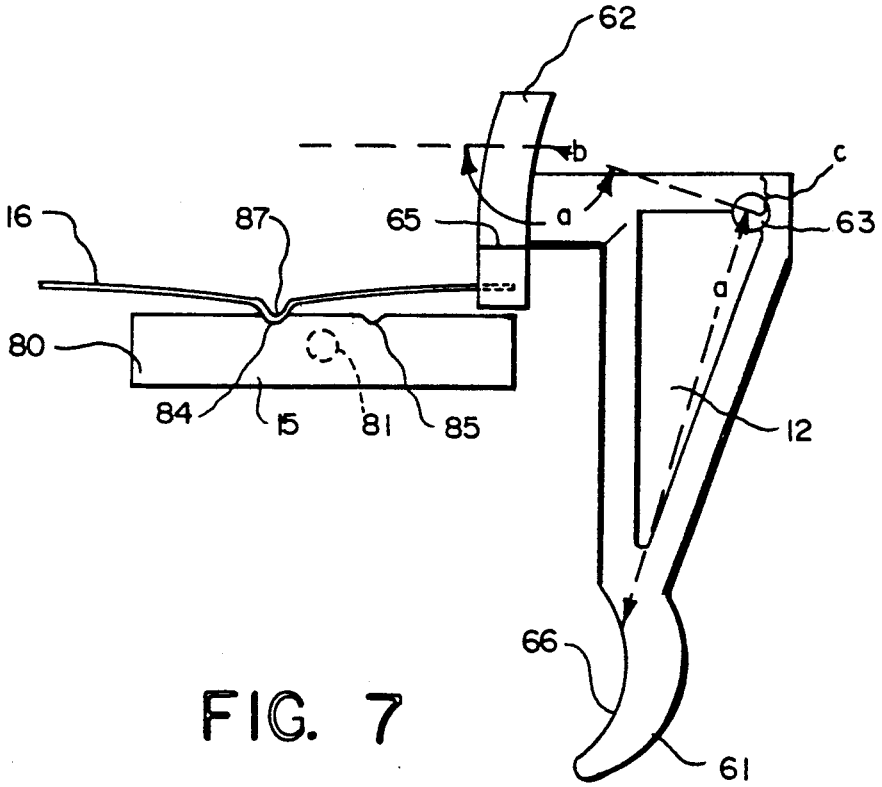
Figure 6:
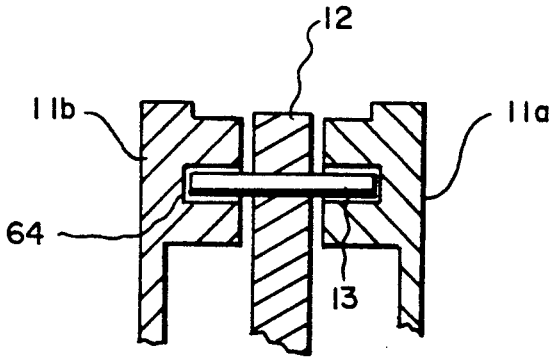

Stock 11 is formed from two molded matching pieces 30 and 31, FIGS. 3 and 5, generally fashioned in the shape of a rifle or shotgun stock and which have apposite edges 33*a* and 33*b* which are cemented together by an approprate glue, such as a methyl ethyl ketone glue, following assembly of the trigger and bow string release member 12, the pivot pin 13, the retraction spring 14, the trigger safety latch 15, and leaf spring 16. Recesses are formed in molded pieces 30 and 31, shaped and sized so as to receive and retain trigger and bow string release member 12, pivot pin 13, retraction spring 14, safety latch 15, and leaf spring 16. As is evident, when molded pieces 30 and 31 are cemented together, these parts are permanently sealed in place within the stock, thus rendering them substantially tamper free.

Trigger guard 20 is secured to stock 11 by means of self tapping screws 37*a* and 37*b*, FIG. 4, received by recesses 35 and 36 in stock 11. Also, holes 38 are provided extending completely through stock 11 near the front end of the stock to accept screws 38*a* and 38*b* which secure nose piece 12 in place at the forward portion of the stock.

The side surfaces 11*a* and 11*b* of stock 11, near the butt end 11*f*, are fashioned such that each provides a Monte Carlo shaped cheek piece, such as 40. With both sides being so fashioned, the stock can be used by either a right-handed person who normally sights with his right eye or a left-handed person who normally sights with his left eye.

Stock 11 also has a substantially rectangular shaped indentation 41 formed along it upper surface rearwardly of the trigger and bow string release member which is adapted to receive rear sight mounting member 23 which is held in place by means of cement, such as Loctite Prism 411 glue.

Stock 11 also has an elongate slot 42 formed along its upper surface, extending from the rear sight location to the front of the stock, i.e., forwardly of the trigger and bow string release member. This slot forms an arrow track 19 and preferably includes polished brass rails 43 and 44 glued, such as by Loctite Black Max super glue, to the stock. The two upper rolled edges of rails 43 and 44 are spaced apart somewhat less than the diameter of an arrow, which thus serve to hold and guide an arrow 45. Recess 42 is deep enough to allow the fletching 46 of arrow 45 to rest therein and pass therealong as the arrow moves along the arrow track.

The butt end of stock 11 is also contoured so as to receive and hold a resilient recoil pad 21 as shown assembled in FIGS. 1 and 2. Recoil pad 21 is fashioned from any suitable resilient molding material, such as rubber, and is preferably cored to facilitate molding.

The molded stock pieces 30 and 31 may be fashioned from any suitable material adapted for molding and having the required strength. A suitable material is an ABS 20% fiberglass filled composite plastic with either a synthetic walnut or camouflage appearance. This material is resistant to cracking, breaking, splitting, warping, shrinking, scuffing, and scratching. In addition, it is substantially impervious to rain, snow, heat, cold, and humidity.

Nose piece 18, FIG. 1, is preferably cast as a single piece from aluminum, zinc, or alloy although it may be machine fabricated from a solid block. A transverse passageway 50, having a rectangular cross section, extends through nose piece 18 and is sized and configured to receive and hold therein, by means of set screw 49, the center portion of a conventional crossbow prod 24, in normal manner. A cocking stirrup 54, referably formed as an integral part of nose piece 18, is T-shaped and has a pair of transverse elongate projections 55 and 56 to allow a user to place his feet thereon to hold the front of the crossbow substantially stationary while cocking the cross bow thus leaving one or both of the user's hands free to draw back and cock the bow string. With this arrangement, most users will be able to exert a cocking force of up to 200 pounds. Mounting holes are provided in nose piece 18 which match and align with corresponding holes 38 in stock 11 so as to receive screws 38*a* and 38*b*. Preferably, screws 38*a* and 38*b* will extend through the holes in one side of nose piece 18, holes 38 in stock 11, and be threaded into receiving holes on the opposite side of the nose piece.

A sighting hole 56 projects downwardly from the front face of nose piece 18 and intersects passageway 50, thereby providing means for a user to sight therethrough and accurately align a positioning mark at the center of prod 24.

The trigger and bow string release arrangement of the invention is shown in detail in FIGS. 4, 5, 6, and 7. A unitary trigger and bow string release member 12 is fashioned as shown. Member 12 is preferably an aluminum, zinc, or alloy die-cast piece although it may be machined from solid stock. Member 12 has a trigger portion 61 which extends from the lower surface of the stock, a bow string release portion 62 which extends from the upper surface of the stock, a pivot hole 63, and a springbearing portion 65. Pivot hole 63 is adapted to receive pivot pin 13 therethrough which, in turn, is received by mounting recesses 64 in stock 11 when the stock is assembled, FIG. 6. Rather than being a separate piece, pivot pin 13 can be an integral part of the trigger and bow string release member. Trigger portion 61 has an arcuately formed trigger 66, shaped to provide a comfortable actuating surface for the finger of a user. The distance "a" (seeFIG. 7) from pivot hole 63 to trigger 66 is defined for purposes of the application as the trigger pivotal crank arm for the force exerted by the finger of the user.

Bow string release portion 62 is arcuately formed having a radius approximately equal to the distance "b" which is the distance from pivot hole 63 to portion 62. This distance "b" is defined for purposes of this application as the bow string release pivotal crank arm for any rotational force exerted by a cocked bow string at the point of contact of the bow string against bow string release portion 62.

Member 62 has a substantially flat spring bearing surface 65 adapted to bear against retraction spring 14, as shown. Retraction spring 14 is adapted to fit into recess 34*a* when assembled to stock 11.

Thus, when cocked, bow string 25 bears against bow string release portion 62, and has a component of the cocked force tending to rotate member 12 around pivot pin 13 in a direction which, if not opposed, would release the bow string. Opposition to such rotational motion is provided by spring 14 which urges member 12 in an opposite rotational direction. The rotational component of the cocked force is minimized by maximizing the angle "α", FIG. 7, up to 180°, between the direction of the cocked force and the crank arm "b". This is effected by positioning pivot pin 13 as nearly in line with the cocked bow string as possible. This, in turn, is effected by minimizing the distance "c" and maximizing the length of crank arm "b", within practical limits. In the embodiment depicted herein, "c" is approximately ¼ inch and "b" is approximately one inch. This results in the angle "α" between the direction of the cocked force and the crank arm "b" being approximately 167°, which is satisfactorily close to the optimum 180°.

Additional protection against the force of the cocked bow string from causing rotation of bow string release portion 62 is afforded by positioning the contact point of the bow string against release portion 62 closely adjacent to the upper surface of stock 11, thus effectively inhibiting rotation of release portion 62. In this embodiment, the result of the above design parameters is such that the force exerted by the cocked bow string against bow string release portion 62 must be considerably in excess of 200 pounds in order for such force to rotate member 12 to the point where the bow string would be released.

Another requirement is that the force required by the finger of an operator against trigger portion 61 should be approximately seven pounds to effect release of the bow string. A value much less than this would result in a "hair trigger" device, thus imperiling safety. A value much greater than this would be detrimental to easy use by many users. This is determined in the embodiment primarily by the force required to compress spring 14, and the length of crank arm "a", which in this embodiment is approximately 2½ inches.

The trigger safety latch 15 comprises a bar 80 having a rectangular cross section and adapted to be positioned in recess 34*b* in stock 11, FIGS. 4 and 5. Latch 15 is also equipped with a post 81 attached to bar 80, as shown, and which protrudes through elongate slit 82 in stock 11. Thus, latch 15 may be slid rearwardly to a "safety on" position, and forwardly to a "safety off" position, by a user. When slid rearwardly, FIG. 7, it engages surface 83 of trigger and bow string release member 12 thus preventing member 12 from being rotated. Conversely, when slid fowardly, FIG. 4, it offers no impediment to rotation of member 12.

In addition, bar 80 has two notches 84 and 85 along one side. An elongate leaf spring 16 having a wrinkle 87 approximately midway along its length is positioned in recess 34*b* above bar 80, as shown. When latch 15 is slid to the "safety on" position, the wrinkle 87 engages notch 84 in bar 80, which thus acts as a detent to hold bar 80 securely in "safety on" position. When latch 15 is slid to the "safety off" position, the wrinkle 87 engages notch 85.

Trigger guard 20 is attached to stock 11 by means of screws 37*a* and 37*b* inserted into corresponding recesses 35 and 36, respectively, in stock 11. Trigger guard 20 partially surrounds trigger 66 and is so shaped and adapted as to guard against unintended action of trigger 66, in a conventional manner.

Rear sight mounting member or block 23 is affixed to stock 11 by cementing with a suitable adhesive, such a Loctite Prism 411 glue. Block 23 has a conventional grooved dovetail upper surface adapted to mount various standard rear sights, including scope sights.

Mounting block 23 also incorporates an overhang portion 90, as shown, which projects above, and slightly clears, the bow string release portion, thus providing protection against accidental discharge of a cocked arrow. Mounting block 23 also incorporates a cantilever spring member 91 projecting forwardly and downwardly so as to bear against an emplaced arrow, thus serving to keep the arrow positioned against arrow track 19.

Front sight mounting member 22 is fashioned in the shape of a "U" shaped bracket 95 and is adapted to straddle nose piece 18, as shown in FIG. 1. Bracket 95 has an elongate slot 96 in each leg and an elongate slot 97 in the leg-connecting portion of the "U" shaped bracket. Bracket 95 is assembled to nose piece 18 by means of screws 98 engaging the slots in the legs of the bracket. The slots thus allow vertical adjustment of the front sight, thus providing a range adjustment.

The sight 26 is attached to bracket 95 by means of a screw passing through slot 97. Thus, sight 26 may be adjusted horizontally to provide a windage adjustment which supplements the normal windage adjustment normally provided by the rear sight.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A crossbow assembly, comprising an elongate stock having two opposing side surfaces, a relatively narrow upper surface, a relatively narrow lower surface, a front nose surface, and a rear butt surface; a unitary trigger and bow string release member pivotally mounted within the stock so that a trigger portion of said member extends from the relatively narrow lower surface of the stock to form a trigger and a bow string release portion extends from the relatively narrow upper surface of the stock to form a bow string holding and release means; pivot means mounting the trigger and bow string release member within the stock so that movement of the trigger portion about the pivot mounting from a cocked to released position causes movement of the bow string release portion from a bow string holding position wherein a bow string is held in a cocked position by resting against the bow string holding and release portion of the member to a bow string released position wherein the bow string holding and release portion of the member has pivoted to release the bow string; and retraction means for urging the trigger and bow string release member to a position wherein the trigger portion is in its cocked position and the bow string release portion is in its bow string holding position.

2. A crossbow assembly according to claim 1, additionally including a nose piece secured to the nose surface of the stock, said nose piece having a passageway therethrough adapted to receive and hold a prod in operable position with respect to the stock.

3. A crossbow assembly according to claim 2, wherein the nose piece includes a T-shaped cocking stirrup integrally formed therewith having a pair of transverse elongate projections adapted to be held by at least one of a user's feet during cocking of the crossbow.

4. A crossbow assembly according to claim 2, additionally including a front sight mounting member mounted to the nose piece for adjustable vertical positioning; and a front sight mounted on the front sight mounting member for adjustable horizontal positioning.

5. A crossbow assembly according to claim 1, which additionally includes safety latch means for selectively latching or unlatching the trigger and bow string release member such that when latched said trigger and bowstring release member is locked in its bow string holding position.

6. A crossbow assembly according to claim 5, wherein the safety latch means includes a safety bar mounted for movement between a latched position wherein the bar is in latching engagement with the trigger and bow string release member and an unlatched position allowing pivoting of the trigger and bow string release member between cocked and released positions, said safety bar having a detent notch, and a metallic leaf spring employing a wrinkle which cooperates with the detent notch in the safety bar when the safety bar is placed in latched position to hold the safety bar in latched position.

7. A crossbow assembly according to claim 5, wherein the safety latch means comprises a slidable elongate member positioned in a receiving recess in the stock and so configured and adapted to be slidably moved between a safety "on" position where it engages a portion of the trigger and bow string release member so as to prevent pivotal motion of said member, and a safety "off" position were it does not engage said member.

8. A crossbow assembly according to claim 5, additionally including a trigger guard assembled to the lower surface of the stock and which partially surrounds the trigger; an elongate arrow track assembled to the upper surface of the stock adapted to hold and initially guide an arrow when released for flight, and which includes an elongate recess therein which serves as a passageway for a fletching of the arrow; a recoil pad assembled to the butt surface of the stock; a nose piece assembled to the nose of the stock which is adapted to receive and hold in place a prod and also to receive and hold a front sight mounting member; a front sight mounting member adapted to receive and hold in place a front sight; and a rear sight mounting member assembled to the upper surface of the stock in the vicinity of the trigger and bow string release member and which is adapted to receive and hold in place a rear sight.

9. A crossbow assembly according to claim 5, wherein the stock comprises two elongate molded matching members adapted to be assembled together and permanently affixed together by cementing opposite edge surfaces together.

10. A crossbow assembly according to claim 9, wherein each molded matching member has cooperating recesses therein for receiving, and sealing therein, the trigger and bow string release member, the pivot means, the retraction means, and the trigger safety latch means.

11. A crossbow assembly according to claim 9, wherein the molded matching members are configured so that when assembled together they form an elongate arrow track groove extending along the upper surface of the stock forwardly of the bow string release portion of the trigger and bow string release member to accept an arrow along the top of the track with a fletch of the arrow extending into the groove.

12. A crossbow assembly according to claim 9, additionally including a rear sight mounting block secured to the upper surface of the stock rearwardly of the bow string release portion of the bow string release member.

13. A crossbow assembly according to claim 12, wherein the rear sight mounting block is secured to the upper surface of the stock adjacent the bow string release portion of the bow string release member and includes a portion extending forwardly over the bow string release portion of the bow string release member to provide a protective cover for such member.

14. A crossbow assembly according to claim 13, wherein the rear sight mounting block is adapted to receive a scope sight.

15. A crossbow assembly according to claim 9, additionally including a recoil pad secured to the rear butt surface of the stock and adapted to rest comfortably against the shoulder of a user.

16. A crossbow assembly according to claim 9, wherein each molded matching member includes a cheek piece molded into the side surface near the rear butt surface of the stock to thereby provide a cheek piece on each side of the stock whereby the same stock may be used by either a right-handed or left-handed person.

17. A crossbow assembly according to claim 9, wherein the pivot means comprises a transverse pivot pin passing through the trigger and bow string release member and having ends adapted to be rotatably received in a recess in each of the molded members when assembled together to form the stock.

18. A crossbow assembly according to claim 9, wherein the retraction means comprises a spring.

19. A crossbow assembly according to claim 9, wherein the trigger portion has a trigger pivotal crank arm extending approximately from the pivot pin to said trigger portion, and the bow string release portion has a bow string release pivotal crank arm extending approximately from said pivot pin to said bow string release portion.

20. A crossbow assembly according to claim 19, wherein the bow string release portion is substantially arcuately shaped with a radius approximately equal to the length of the bow string release pivotal crank arm.

21. A crossbow assembly according to claim 19, wherein the trigger portion has an arcuately shaped trigger near the extremity of the trigger pivotal crank arm adapted to comfortably engage the finger of a user exerting rearward pressure against said trigger.

22. A crossbow assembly according to claim 19, wherein the trigger portion is so configured and emplaced that the force of a user's finger against the trigger portion is directed at approximately ninety degrees with respect to the trigger pivotal crank arm.

23. A crossbow assembly according to claim 19, wherein the bow string release portion is so configured and emplaced that the force of a cocked bowstring against the bow string release portion is directed at an angle lying between one hundred and fifty degrees and one hundred and eighty degrees with respect to the bowstring release pivotal crank arm.

24. A crossbow assembly according to claim 23, wherein the contact point of the cocked bowstring against the bowstring release portion is approximately adjacent the upper surface of the stock.

* * * * *